United States Patent [19]

Gonzalez

[11] 4,221,074

[45] Sep. 9, 1980

[54] HOOP TOY

[76] Inventor: Reymundo Gonzalez, 520 Hoefgen St., San Antonio, Tex. 78203

[21] Appl. No.: 924,742

[22] Filed: Jul. 14, 1978

[51] Int. Cl.[2] ..... A63H 1/32; A63B 5/00

[52] U.S. Cl. ..... 46/47; 46/51; 273/DIG. 17; 273/DIG. 19; 272/67; 272/94; 272/119; 272/134; 272/143

[58] Field of Search ..... 46/1 F, 47, 1 G, 51; 273/DIG. 19, DIG. 17; 272/143, 67, 128, 94, 119, 134

[56] References Cited

U.S. PATENT DOCUMENTS

| | | | |
|---|---|---|---|
| 3,015,907 | 1/1962 | Fasano | 46/47 |
| 3,086,315 | 4/1963 | Fasano | 46/51 |
| 3,178,851 | 4/1965 | Gage | 46/51 |
| 3,184,884 | 5/1965 | Petrucelli | 46/51 |
| 3,186,124 | 6/1965 | Voss | 46/51 |
| 3,200,536 | 8/1965 | Petitto, Sr. | 46/51 |
| 3,306,612 | 2/1967 | Rosen | 46/47 |
| 3,345,772 | 10/1967 | Sam | 46/51 |
| 3,550,312 | 12/1970 | East | 46/52 |
| 3,946,518 | 3/1976 | Ylitalo | 46/47 |
| 4,018,444 | 4/1977 | Chew, Jr. et al. | 46/51 |
| 4,049,264 | 9/1977 | Holcombe, Jr. | 46/51 |

OTHER PUBLICATIONS

*Playthings,* vol. 58 (1960), No. 3, p. 388, "Whirl-A--Wand".

*Primary Examiner*—Louis G. Mancene
*Assistant Examiner*—Michael J. Foycik, Jr.
*Attorney, Agent, or Firm*—Harrington A. Lackey

[57] ABSTRACT

A hoop toy including an elongated rod having a pair of spaced abutment members adjacent one end and adapted to be held at the opposite end for twirling gyratory movement, and further including a large hoop and a coupling ring member adapted to encircle a portion of the hoop and the portion of the rod between the abutment members to permit the hoop to twirl about the rod only between the abutment members.

The hoop toy is further characterized by various means for holding the opposite end of the rod for twirling movement, such as a head-supported socket member, a hip-supported socket member, and a hand-held socket member.

8 Claims, 7 Drawing Figures

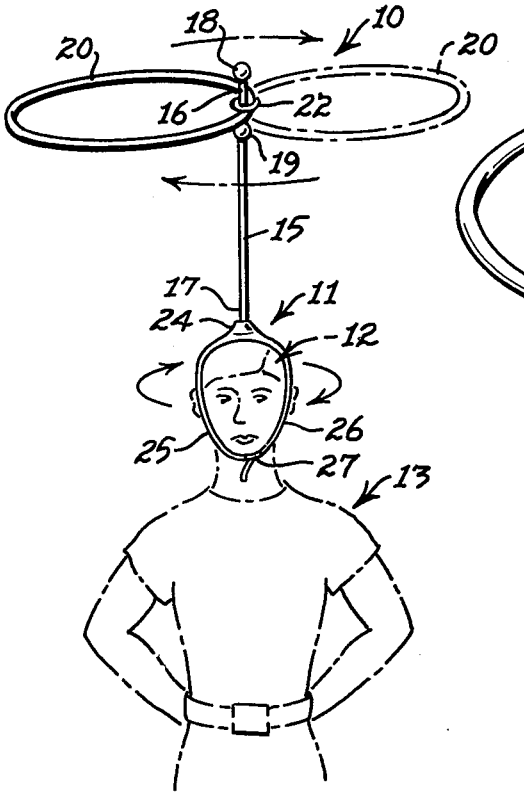
Fig. 1
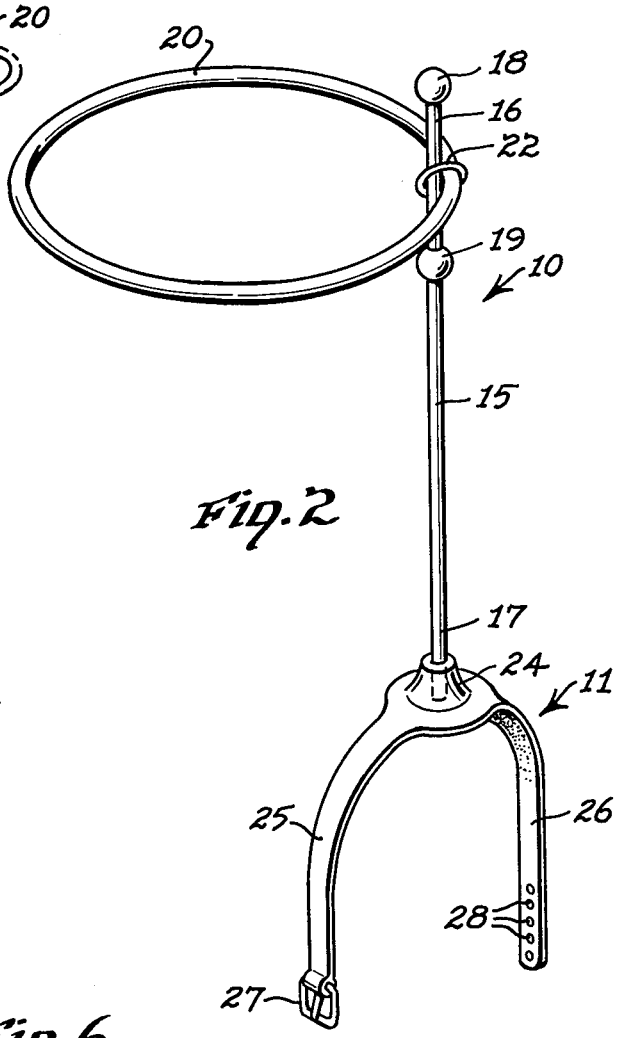
Fig. 2
Fig. 6
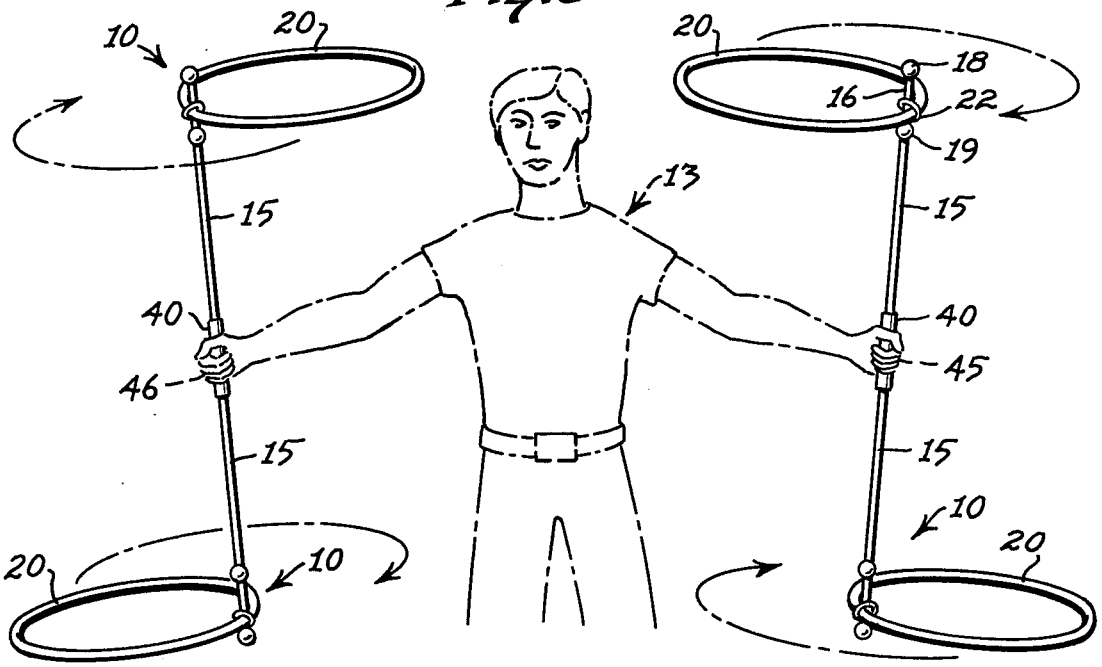

HOOP TOY

BACKGROUND OF THE INVENTION

Hoop toys of various types are well-known in the art, such as those disclosed in the following U.S. patents:

| | | |
|---|---|---|
| 2.928.206 | Kuhn | Mar. 15, 1960 |
| 2950565 | Bridges | Aug. 30, 1960 |
| 2,956,369 | Rolin | Oct. 18, 1960 |
| 2,958,156 | Schmahl et al | Nov. 1, 1960 |
| 3,015,907 | Fasand | Jan. 9, 1962 |
| 3,086,315 | Fasand | Apr. 23, 1963 |
| 3,178,851 | Gage | Apr. 20, 1965 |
| 3,184,884 | Petrucelli | May 25, 1865 |
| 3,186,124 | Voss | June k, 1965 |
| 3,200,536 | Petitto, Sr. | Aug. 17, 1965 |
| 3,295,250 | Poje | Jan. 3, 1967 |
| 3,306,612 | Rosen | Feb. 28, 1967 |
| 3,345,772 | Sam | Oct. 10, 1967 |
| 3,550,312 | East | Dec. 29, 1970 |
| 3,940,878 | Panico | Mar. 2, 1976 |
| 3,946,518 | Ylitalo | Mar. 30, 1976 |
| 4,018,444 | Chew, Jr. et al | Apr. 19, 1977 |
| 4,037,356 | Cantland | July 26, 1977 |

SUMMARY OF THE INVENTION

However, it is an object of this invention to provide a hoop toy including a large hoop adapted to be twirled about one end of a rod, but only along a limited portion of that end of the rod, so that the hoop will not twirl off of the rod.

More specifically, this hoop toy includes a large hoop which is loosely connected to a first or remote end of an elongated twirling rod between a pair of spaced abutment members. The hoop is connected by a coupling ring member which encircles not only the hoop but also the portion of the rod between the spaced abutment members. The diameter of the ring member is such that the hoop is loosely held and is free to twirl about the limited end portion of the rod, but the ring member will not move past either abutment member.

The opposite, or controlled, end of the rod is adapted to be held in a socket member, which is provided with alternate means for holding the socket member upon a movable body part of the operator for twirling the rod upon movement of that body part. For example, one holding means includes a socket member having head straps adapted to support the socket member upon the top of the head of the operator for twirling of the hoop by movement of the head. In another variation, the socket member is supported upon a waist or hip strap so that the socket member rests over one side hip of the operator for twirling the hoop by movement of the hip. Another variation includes a double-socket member adapted to be hand-held and adapted to support oppositely directed, but longitudinally aligned, rods for a pair of hoop toys for simultaneous twirling by movement of the operator's hand.

BRIEF DESCRIPTION OF THE DRAWINGS

FIG. 1 is a front view of the hoop toy made in accordance with this invention in operative position mounted upon the head of the operator;

FIG. 2 is an enlarged, perspective view of the hoop toy disclosed in FIG. 1;

FIG. 6 is a front view of four hoop toys made in accordance with this invention, each pair of hoop toys being mounted on a hand-held socket member.

DETAILED DESCRIPTION

Figure 5:
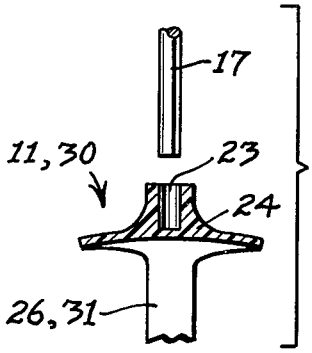
FIG. 5 is an enlarged, fragmentary sectional exploded view of the socket member and rod, shown fragmentarily.

Referring more particularly to the drawings, FIGS. 1 and 2 disclose a hoop toy 10, made in accordance with this invention, connected to head-mounted socket member 11, for attaching the hoop toy 10 to the head 12 of the operator 13.

The hoop toy 10 includes an elongated rod 15, preferably of uniform, circular cross-section having a first or remote end portion 16 and a second or controlled end portion 17. The remote end portion 16 has its extremities defined by a pair of abutment members 18 and 19. Each abutment member 18 and 19 is preferably of a circular cross-section coaxial with and larger than the circular cross-section of the remote rod end portion 16. As disclosed in the drawings, the abutment member 18 is spherical and fixed to the remote end of the rod 15. The abutment member 19 is fixed upon the rod 15 at a spaced distance from the abutment member 18.

Adapted to ride upon and twirl about the remote end portion 16 is a large twirling hoop 20, of substantially greater diameter than the rod 15 and the abutment members 18 and 19.

Securing the large twirling hoop 20 upon the remote rod portion 16 is a small coupling ring member 22. The ring member 22 encircles a portion of the hoop 20 and simultaneously the remote end portion 16 of the rod 15. The size, or diameter of the coupling ring member 22 is such that it loosely encircles a section of the hoop 20 and the rod end portion 16 so that the hoop 20 is free to rotate and twirl about the rod end portion 16 when rod 15 is twirled in a gyratory motion about its own longitudinal axis.

Furthermore, the size or diameter of the coupling ring member 22 is small enough that when the ring member 22 encircles the section of the hoop 20 and the remote end portion 16, the ring member 22 and the encircled hoop 20 can move longitudinally along the rod end portion 16 only between the abutment members 18 and 19. The relative sizes of the ring member 22 and the abutment members 18 and 19 are such that the abutment members 18 and 19 limit or obstruct the movement of the ring member 22 longitudinally beyond the abutment members 18 and 19. The abutment members 18 and 19 provide limiting stops for the longitudinal motion of the ring member 22 as well as the hoop 20.

Accordingly, the hoop 20 is always connected to the rod 15, whether in its operative twirling motion, or whether it is in its inoperative state of rest.

The length of the remote end portion 16 of the rod 15, although limited, is sufficient to permit limited longitudinal movement of the ring member 22 as well as the encircled portion of the hoop 20 along the rod end portion 16.

As disclosed in FIGS. 1 and 2, the second or controlled end portion 17 of the rod 15 is adapted to snugly fit within a complementary cylindrical hole 23 of a socket 24 of the socket member 11. Depending from opposite sides of the socket member 11 are a pair of head straps 25 and 26, the extremities of which are provided with coupling means for securing the straps 25 and 26 about the head 12 of the operator 13. The particular fastening means disclosed in FIGS. 1 and 2 are a belt buckle 27 on the extremity of the strap 25 and a plurality of buckle holes 28 on the strap 26.

Thus, with the rod 15 secured in the socket member 11 and the straps 25 and 26 secured about the head 12 of the operator 13, the hoop 20 may be rotated or twirled about the upper or remote end portion 16 between the abutment members 18 and 19 by rotary movement of the operator's head 12, as disclosed in FIG. 1.

Figure 3:
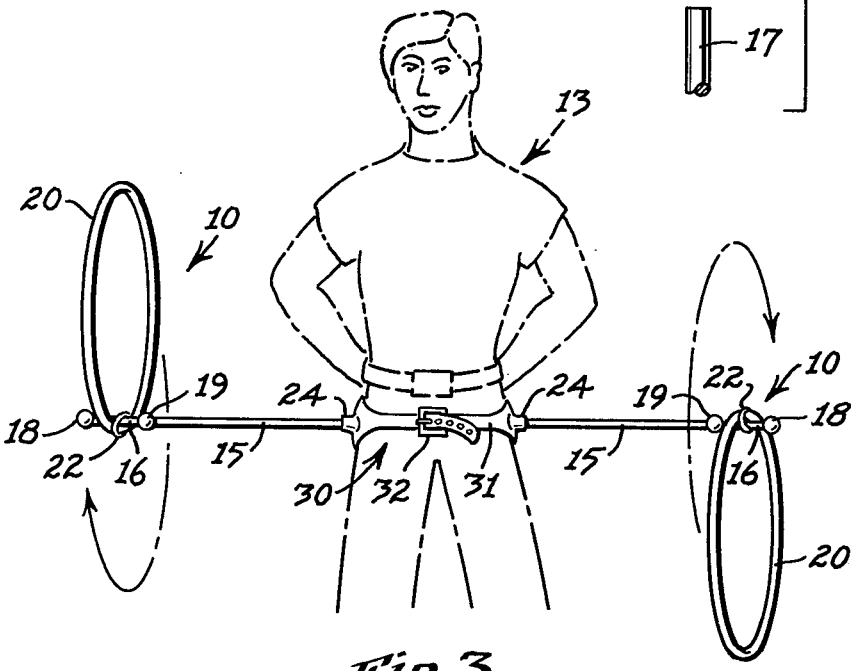
FIG. 3 is a front view of a pair of hoop toys made in accordance with this invention, in operative position mounted upon the hips of the operator.
Figure 4:
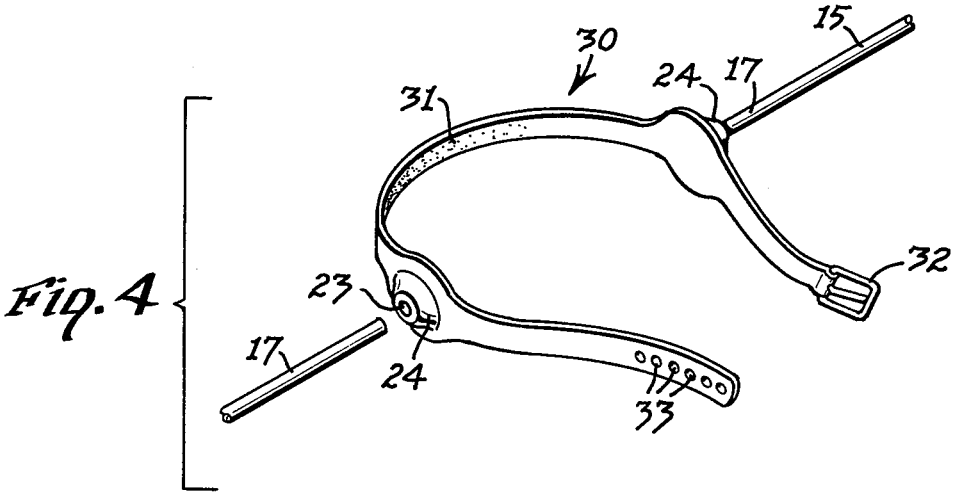
FIG. 4 is a top front perspective view of the hip mounting strap disclosed in FIG. 3, disclosing the assembly of the rods, shown fragmentarily, of the hoop toy.

As disclosed in FIGS. 3 and 4, a pair of hoop toys 10 are adapted to be mounted by their rods 15 on opposite sides of the hips of the operator 13 by means of a modified socket-mounting means 30. The socket mounting means 30 includes a belt 31 adapted to fit around the waist, but preferably about the hips, of the wearer or operator 13. The belt 31 is provided with fastening means, such as a buckle 32 and buckle holes 33.

Formed in opposite sides of the belt 31 are a pair of sockets 24 having cylindrical socket holes 23, each socket being substantially the same as the socket 24 in the head-mounted socket member 11. The second or controlled ends 17 of the rods 15 of the pair of hoop toys 10 are received in the corresponding cylindrical holes 23 of the opposite sockets 24, as disclosed in FIGS. 3 and 4. With the hoop toys 10 supported by the mounting socket member 30, as disclosed in FIG. 3, the operator 13 may twirl the hoops 20 on opposite sides by the skilled movement of his hips, so that the hoops 20 are rotated in opposite directions and approximately 180° out of phase.

The specific construction of the socket 24 for either the head-mounted socket member 11 or the hip-mounted socket member 30 is disclosed in FIG. 5.

Figure 7:
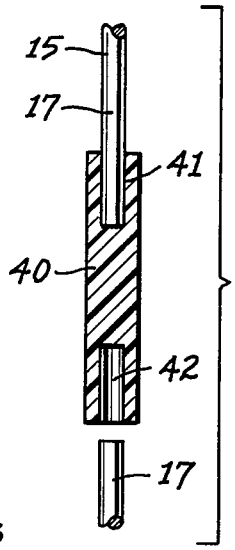
FIG. 7 is an enlarged, fragmentary sectional view of the hand-held socket member of FIG. 6.

As disclosed in FIG. 6, a pair of hoop toys 10 may be rigidly and simultaneously supported by a hand-held socket member 40. As best disclosed in FIG. 7 the socket member 40 is elongated and preferably cylindrical having a cylindrical socket hole 41 formed in one end of the socket member 40 and a like cylindrical socket hole 42 formed in the opposite end of the socket member 40. Thus, the second or controlled end 17 of each rod 15 of a pair of oppositely disposed hoop toys 10 may be snugly received in the corresponding socket holes 41 and 42. When the operator 13 grasps a socket member 40 with his hand 45, he can manipulate and twirl two hoop toys 10 simultaneously so that the hoops 20 are rotating about the respective extremities of the respective hoop toys 10, in the same rotary direction, but approximately 180° out of phase.

FIG. 6 also discloses that another pair of hoop toys 10 may be mounted in a second hand-held socket member 40, so that the operator 13 may grasp two socket members 40 with both hands 45 and 46 to simultaneously twirl four hoop toys 10.

It will be noted that the numerous gyratory movements of one or more hoop toys 10 may be effected by the various types of attachment members for different movable parts of the body. Moreover the versatility of this hoop toy 10 is also provided by the incorporation of the coupling ring member 22 of its particular shape and size for loosely coupling the large hoop 20 to the remote end portion 16 of the rod 15 between the abutment members 18 and 19 to prevent the hoop 20 from becoming separated or falling off of the rod 15 during its operative twirling movements, or during its state of rest.

What is claimed is:

1. A hoop toy comprising:

(a) an elongated rod having first and second ends, a remote end portion adjacent said first end, and a controlled end portion adjacent said second end, (b) first and second longitudinally spaced annular abutment members fixed on said rod and defining the extremities of said remote end portion, the transverse dimension of each of said abutment members being greater than the transverse dimension of said rod, (c) a large twirling hoop having a diameter substantially greater than the transverse dimension of either of said abutment members, (d) a coupling ring member loosely encircling simultaneously a portion of said hoop and said remote end portion between said abutment members, (e) the diameter of said coupling ring member being small enough that the longitudinal movement of said ring member encircling said remote end portion and said hoop, along said remote end portion, is limited between said abutment members.

2. The invention according to claim 1 in which said first abutment member is fixed on said first end.

3. The invention according to claim 1 in which the length of said controlled end portion of said rod is greater than said remote end portion.

4. The invention according to claim 1 in which said remote end portion has a uniform circular cross-section and each of said abutment members has a circular transverse cross-section concentric with the longitudinal axis of said rod.

5. The invention according to claim 1 further comprising a socket member adapted to securely receive said second end for rotary gyratory movement of said rod about its longitudinal axis to twirl said hoop about said remote end portion, and attachment means for attaching said socket member to a movable body part of the operator for rotary gyratory movement of the hoop toy upon movement of said body part.

6. The invention according to claim 5 in which said attachment means comprises strap means for attaching said socket member to the top of the head of the operator.

7. The invention according to claim 5 in which said attachment means comprises strap means for attaching said socket member to the hip of the operator.

8. The invention according to claim 5 in which said socket member comprises an elongated socket member having a longitudinal axis and adapted to be hand-held, and including first and second oppositely disposed sockets in opposite ends of said socket member, said hoop toy comprising first and second hoop toys, each comprising identical rods, abutment members, twirling hoops and coupling ring members, said first socket receiving the second end of the rod of said first hoop toy and said second socket receiving the second end, of the rod of said first hoop toy and said second socket receiving the second end of the rod of said second hoop toy, so that the rods of said first and second hoop toys extend in opposite directions and are longitudinally aligned.

* * * * *